United States Patent [19]

Piaget et al.

[11] 4,035,048

[45] July 12, 1977

[54] GROUNDED CABLE CONNECTOR ASSEMBLY

[75] Inventors: Robert E. Piaget; Charles W. Clyburn, both of Cincinnati, Ohio

[73] Assignee: I.C.M. Industries, Inc., Cincinnati, Ohio ; a part interest

[21] Appl. No.: 568,361

[22] Filed: Oct. 31, 1974

[51] Int. Cl.[2] ..... H01R 13/54

[52] U.S. Cl. ..... 339/91 R; 339/219 R

[58] Field of Search ..... 339/14, 74, 75, 91, 339/253–255, 65, 66, 111, 217, 219, 252

[56] References Cited

U.S. PATENT DOCUMENTS

| | | | |
|---|---|---|---|
| 2,732,531 | 1/1956 | Janowiec | 339/75 P |
| 2,799,009 | 7/1957 | Benander | 339/14 RP |
| 3,064,232 | 11/1962 | Lyman, Jr. | 339/255 R |
| 3,131,012 | 4/1964 | Healy | 339/14 R |
| 3,170,752 | 2/1965 | van Horssen | 339/74 R |
| 3,396,360 | 8/1968 | Piaget | 339/111 |
| 3,676,831 | 7/1972 | Bergwall | 339/74 R |
| 3,784,964 | 1/1974 | Newman et al. | 339/219 R |
| 3,851,946 | 12/1974 | Piaget et al. | 339/259 R |

FOREIGN PATENT DOCUMENTS

| | | | |
|---|---|---|---|
| 289,213 | 12/1915 | Germany | 339/14 R |

*Primary Examiner*—Joseph H. McGlynn
*Attorney, Agent, or Firm*—James W. Pearce; Roy F. Schaeperklaus

[57] ABSTRACT

A cable connector assembly in which connector bodies carry spaced parallel cable contact members. Each cable contact member of one connector body is engageable with one of the cable contact members of the other connector body. A male ground contact is mounted in one of the connectors bodies parallel to the cable contact members thereof and a female ground contact is mounted in the other cable connector body parallel to the cable contact members thereof. A latch in the connector body which has the female ground contact is movable transversely of the female ground contact and can engage in a slot in the male ground contact when the connector bodies are in assembled relation.

14 Claims, 11 Drawing Figures

15
16
18
2
17
4
36
37
62
38
33
32
21
11
78
149
148
109
124
112
106
23
22
20
28
26
16'
27
18'
42
17'

L
M
21
34
134
138
136
141
32
87
81
84
78
142
144
76
94
146
92
7
147
109
124
106
148
123
112
114
116
107
89
104
103
91
93
102
74
22
79
86
98
83
24
99
97
77
20
96

32
144
21
146
147
151
148
149
122
94
89
124
107
106
116
117
123
118
112
114
22
127
121
119
128
20
74
24
126

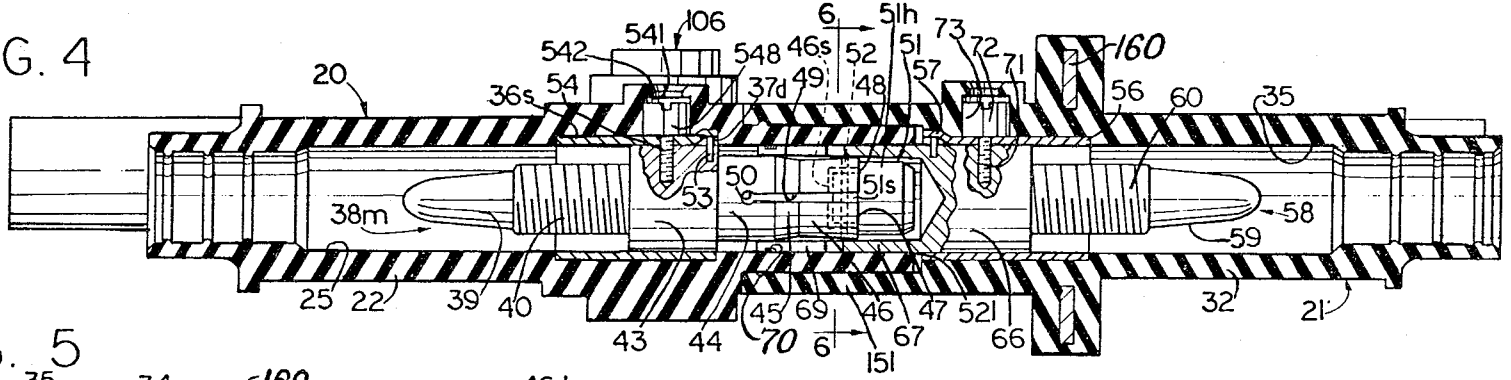
FIG. 4
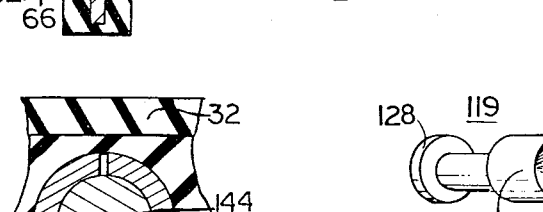
FIG. 5
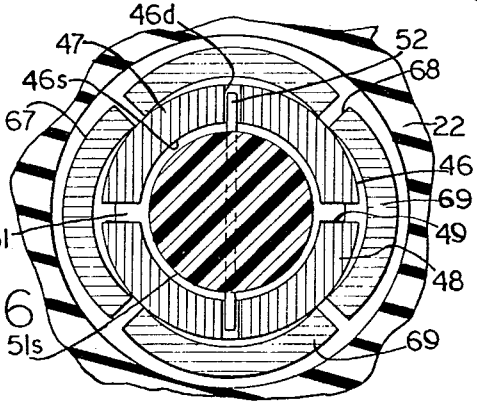
FIG. 6
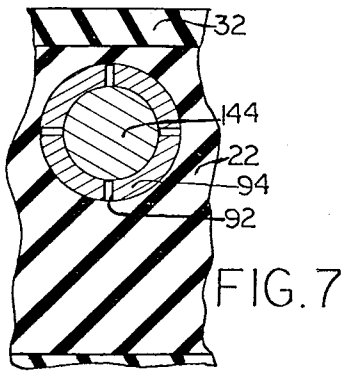
FIG. 7
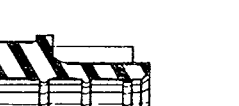
FIG. 8
FIG. 9
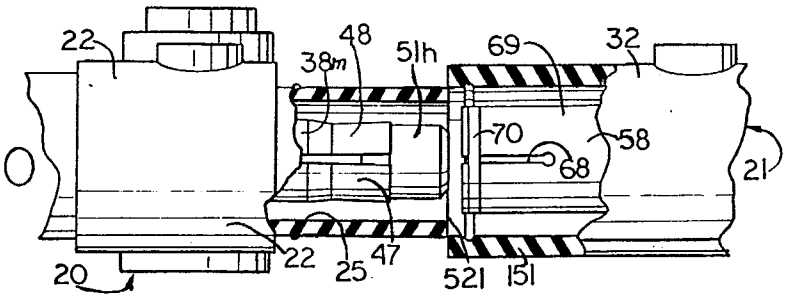
FIG. 10
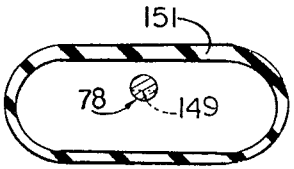
FIG. 11

GROUNDED CABLE CONNECTOR ASSEMBLY

This invention relates to cable connectors.

An object of this invention is to provide a cable connector assembly by which polarized connection of a plurality of main conductors may be effected simultaneously immediately following connection of a ground conductor by a connecting latch which holds the connector assembly in assembled relation and actuates an indicator which shows when the assembly is in assembled relation with the latch in latched condition.

A further object of this invention is to provide a latch structure for a cable connector assembly in which ground cable connections can be secured to latch operating structures.

Briefly, this invention provides a pair of cable connector bodies which can be used for completing cable connections. Each of the cable connector bodies carries a pair of cable contact members each engageable with one of the cable contact members of the other connector body. A ground forming and latch operating member is mounted in each of the connector bodies between the cable contact members thereof. The gound forming and latch operating members cooperate to operate a latching arrangement for the assemblies and in completing a ground connection. The ground forming members are spaced from the plane of the cable contact members so that the cable contact members can be assembled in only one position. The ground forming and latching member of one of the cable connector bodies is a male ground contact member and includes a unitary body having means for attaching a ground conductor to one end portion thereof. The other end portion is of rod shape and extends from the cable attaching end portion and includes a first cylindrical portion, a frusto-conic portion, and a second cylindrical portion terminating in an operating head. The ground forming and latching member in the other cable connector body includes a tubular female ground contact member having teeth at opposite ends. The teeth at one end of the female contact member are constructed to receive the rod shaped portion. As the assemblies are brought together, the male and female members come into engagement before the cable contact members engage. The teeth at the other end of the female ground contact member receive a rod portion of a removable ground connector member having means remote from the rod portion for attaching a second ground conductor. A latch member moves transversely of the female member and is arranged to engage the rod portion of the male contact member to lock the cable connector assemblies in assembled relation. A latch follower is slidably mounted inside the female contact member and engages the latch member to hold the latch member in a released position when the connector bodies are separated. A head of the latch member is exposed to act as an indication of the position of the latch member.

The above and other objects and features of the invention will be apparent to those skilled in the art to which this invention pertains from the following detailed description and the drawings, in which:

FIG. 4 is a view in section taken on line 4—4 in FIG. 1 with the male and female portions of the cable connector in assembled relation, the cables being omitted;

FIG. 5 is a view in end elevation of the female portion of the cable connector;

FIG. 6 is a view in section on an enlarged scale taken generally on the line 6—6 in FIG. 4;

FIG. 7 is a view in section taken on the line 7—7 in FIG. 2;

FIG. 8 is a perspective view of a follower member of the assembly;

FIG. 9 is a view in side elevation of a latch member of the assembly;

FIG. 10 is a fragmentary view in section taken on the line 4—4 in FIG. 1 but with the portions of the cable connector in the intermediate position; and FIG. 11 is a view in section taken on line 11—11 in FIG. 1.

In the following detailed description and the drawings, like reference characters indicate like parts.

The presently preferred illustrative embodiment of the instant invention disclosed in the following written description and illustrated in the accompanying drawings is a safety connector 15 (FIG. 1) useful to connect portions of a polarized circuit as is used in supplying electric current to a machine, a welder, or the like (not shown) through two line-conductors 16–16′,17–17′ only while the supplied device is grounded by way of ground conductors 18–18′.

Figure 1:
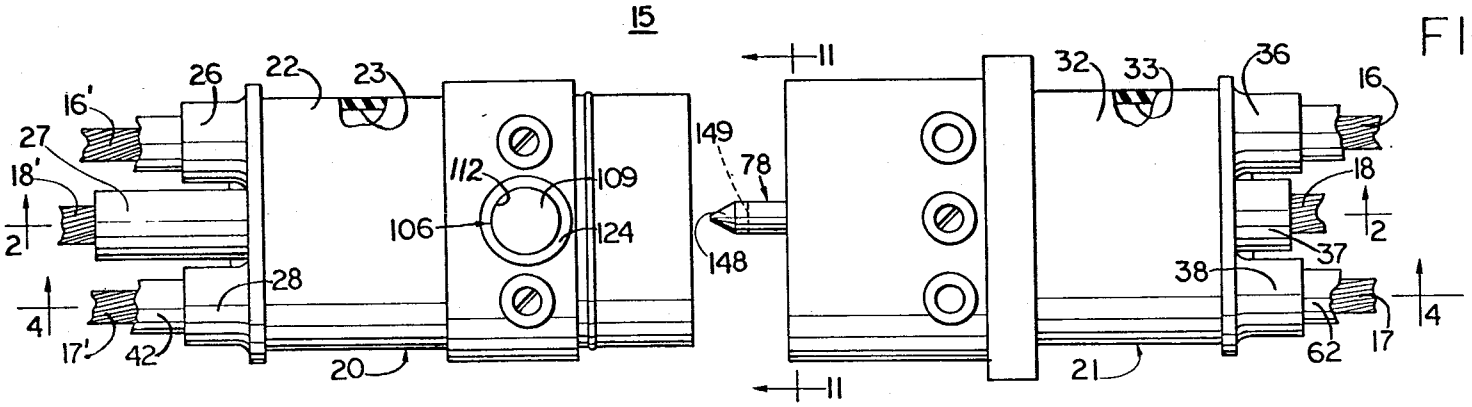
FIG. 1 is an exploded top plan view showing a latchable polarized cable connector assembly constructed in accordance with an embodiment of this invention in open position with portions thereof separated, fragmentary portions of power cables and ground conductors being shown in association therewith.

In FIG. 1 is shown a male connector assembly portion 20 and female connector assembly portion 21, separated, but aligned, for movement into assembled relation to form a connector assembly for connecting the pairs of line-conductors 16–16′,17–17′ and the ground-conductors 18–18′ of a circuit.

The portion 20 has a hollow insulator member 22 through which three parallel lengthwise bores 23, 24 (FIG. 2), and 25 (FIG. 4) extend respectively coaxially with cylindrical portions 26 (FIG. 1), 27 and 28 of the insulator member 22.

Figure 2:
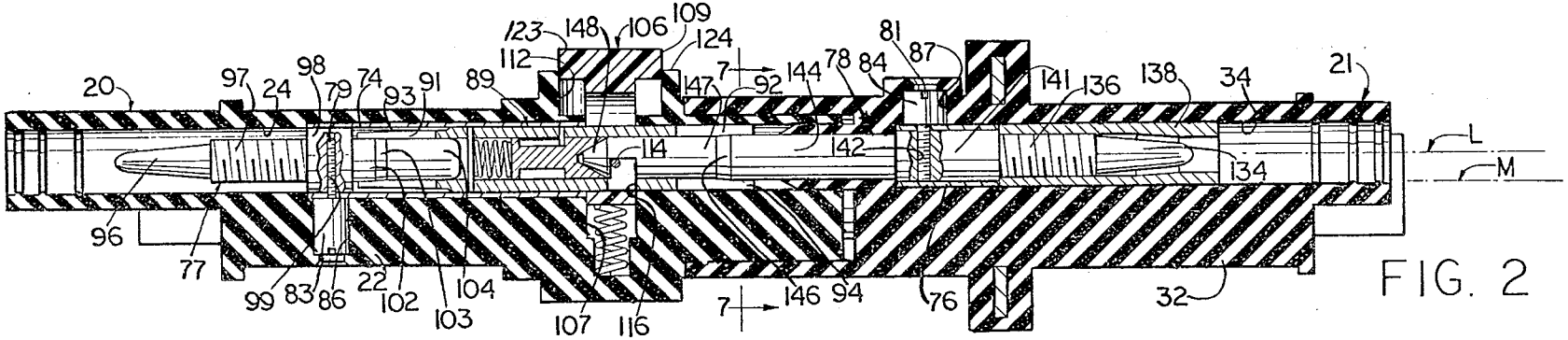
FIG. 2 is a view in section taken on line 2—2 in FIG. 1 with portions of the cable connector in assembled relation, the cables being omitted.

Similarly, the portion 21 has a hollow insulator member 32 through which three parallel bores 33, 34 (FIG. 2, and 35 (FIG. 4) extend respectively coaxially with cylindrical portions 36 (FIG. 1), 37, 38 of the insulator member 32. When the portions 20 and 21 are assembled, the bores are aligned in pairs, 23 with 33, 24 (FIG. 2) with 34, and 25 (FIG. 4) with 35. In FIG. 1 the axes of bores 23–33 and 25–35 are coplanar, and their plane (M in FIG. 2) is lower than the axis of bores 24–34 (L in FIG. 2).

The pair of line-conductor connecting contacts and related structures in the bores 23–33 are duplicated by structures in the bores 25–35 and therefore only the latter will be discussed in detail.

A contact anchor sleeve **36*s* (FIG. 4) having as a guide an indexing detent 37*d* provided and secured annularly of the bore 25 incident to molding of insulator member 22. A male cable contact member 38*m*** includes a unitary body provided with cable connecting structure including a tapered compression section 39 and threaded section 40 of generally conventional configuration for cooperation with a compression nut (not shown) to secure an end portion of the conductor 17' (FIG. 1) of a cable 42 against the tapered section 39 in conventional fashion. The cable connecting structure adjoins a central shoulder portion 43 of cross-section corresponding to the bore of the anchor sleeve 36*s*. Rightwardly from the shoulder 43 (FIG. 4) extends a connector contact end portion including a substantially cylindrical first portion 44, a substantially frusto-conic intermediate portion 45, and an outer end portion 46. The connector end portion is bored to form a socket 46*s* in the end thereof and then divided into two sections or teeth 47 and 48 by a lengthwise diametrically extending slot 49 which terminates in a diametral bore 50. The outer end portion 46 is originally machined to a cylindrical shape of slightly smaller diameter than the diameter of the first section 44. After slotting, the teeth 47, and 48 are then set or deformed outwardly, as shown in an exaggerated fashion in FIG. 4, so that the slot 49 is wider at the free end of the teeth than adjacent the diametrical bore 50. An insulative plug 51 of tough but resilient material having a stem 51*s* extending into the socket 46*s* is secured by a transverse roll-pin 52, the central portion of which is frictionally secured in stem 51*s* with end portions loosely received in diametral bores 46*d* (FIG. 6) in teeth 47, 48, so that the plug 51 remains with its main substantially cylindrical body portion 51*h* projecting beyond the free ends of the teeth 47, 48 as shown in FIGS. 4 and 10, so as to substantially fill the bore 25 adjacent an open end 521 of the bore 25 in the insulator member 22. The plug body 51*h* permits free and normal cooperation of the male and female contacts while simultaneously providing electrical shock protection, viz., it obstructs insertion of an operator's finger through open and 251 of bore 25 into contact with or arcing distance of the free ends of the contact teeth 47, 48. A guide indexing pin 53 (FIG. 4) is set in the shoulder portion 43 so as to project radially interactingly to be received in the guide detent 37*d* when the shoulder portion 43 is positioned in the anchor sleeve 36 and indexes the male contact member 38*m* in a specific position in relation to the insulator member 22. The male contact 38*m* is secured in the bore 25 in the position shown in FIG. 4 by radially drilling and tapping a hole into the shoulder portion 43 of the contact to cooperatively receive the threaded shank of a screw 54 advanced radially through a socket 541 and the aligned bore in anchor sleeve 36*s* into the threaded bore in the shoulder portion 43. The screw 54 preferably has a head 548 which is non-conductive and formed of an insulative material of a size that substantially fills the sockets 541 so that an overhanging lip 542 annularly of the socket 541 precludes inadvertent loss of the screw 54 once same is installed.

A contact anchor sleeve 56 having an indexing detent 57 is provided and secured annularly of the bore 35 incident to molding of the insulator member 32. A female cable contact member 58 includes a unitary body provided with a cable connecting structure including a tapered compression section 59 and threaded section 60 of generally conventional configuration for cooperation with a compression nut (not shown) to secure an end portion of the conductor 17 (FIG. 1) of a cable 62 against the tapered surface 59 in conventional fashion. Leftward of the cable connecting structure in FIG. 4 is a shoulder 66 of cross section corresponding to the bore of the anchor sleeve 56. Leftwardly from the shoulder 66 extends a connector contact end portion including an annular skirt 67 which is divided by slots 68 (FIG. 6) into teeth 69. The outer end portion 46 (FIG. 4) of the male contact member 38*m* is received inside the teeth 69 of the female member 58 in electrical contact therewith when the connector portions 20 and 21 are in the assembled relation of FIG. 4. Adjacent the outer ends of the teeth 69, in the outer face thereof, slot portions may be provided and a ring 70 receiving therein to cooperate with the teeth to provide joint bearing of loads which might produce permanent distortion of one tooth if it bore the load alone. The contact members can thus be generally of the type shown and claimed in copending application Ser. No. 393,270 filed Aug. 31, 1973 of Robert Edgar Piaget, deceased, Dorothy R. Piaget, executrix, and Robert Edward Piaget. A screw 71 locks the female contact member 58 in position inside the anchor sleeve 56. The screw 71 includes a head 72 of non-conductive material which is received in a socket 73 in the insulator member 32.

Figure 3:
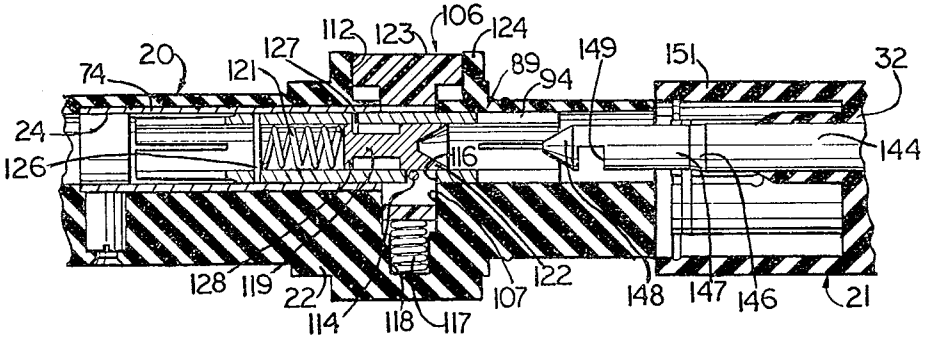
FIG. 3 is a fragmentary view in section taken on the line 2—2 in FIG. 1 with the portions of the cable connector in a position intermediate their separated position shown in FIG. 1 and the assembled relation of FIG. 2.

The male connector assembly portion 20 and the female connector assembly portion 21 are held in assembled relation by a latch structure shown in detail in FIGS. 2 and 3. An anchor sleeve 74 is mounted inside the insulator member 22 in the bore 24 incident to molding and an anchor sleeve 76 (FIG. 2) is similarly mounted inside the insulator member 32 in the bore 34 incident to molding. A cable connector member 77 is removably mounted inside the anchor sleeve 74 and male ground contact member 78 is removably mounted inside the anchor sleeve 76. A screw 79 anchors the cable connector member 77 in the anchor sleeve 74 and a screw 81 anchors the male ground contact member 78 in the anchor sleeve 76. Heads 83 and 84 of the screws 79 and 81 are of non-conductive material and are received in sockets 86 and 87 in the insulator members 22 and 32, respectively. A tubular female ground contact member 89 is frictionally held inside the anchor sleeve 74. End portions of the member 89 are provided with lengthwise slots 91 and 92 dividing the end portions into teeth 93 and 94 (FIG. 7) respectively.

The cable connector member 77 (FIG. 2) includes a tapered compression section 96 and a threaded section 97 of generally conventional configuration for cooperation with a coupling nut (not shown) to secure an end portion of the ground conductor 18' (FIG. 1) against the tapered section 96 in a conventional fashion. Rightwardly of the threaded section 97 is a central shoulder section 98 in which is provided a transverse threaded bore 99 which receives the screw 79. Rightwardly of the shoulder section 98 extends a rod portion including a first cylindrical section 102, a frusto-conic section 103 and a second cylindrical section 104. The diameter of the first cylindrical section 102 is slightly greater than the normal inner diameter of the teeth 93 so that, when the cable connector member 77 is mounted as shown in FIG. 2, the teeth 93 firmly engage the cable connector member 77 at the intersection between the first cylindrical section 102 and the frusto-conic section 103 to make a firm electrical connection therebetween.

A latch member 106 is mounted in a socket 107 in the insulator member 22 for movement transversely of the bore 24. As shown in FIG. 9, the latch member 106 includes a head 109 and a body 111 integral with the head 109. The body 111 moves in the socket 107, and the head 109 moves in a socket 112 (FIGS. 1 and 2) in the member 22. A central opening 113 (FIG. 9) in the latch member 106 receives the female ground contact member 89 (FIG. 2), and the member 89 limits movement of the latch member 106. A latch pin 114 (FIGS. 2, 3, and 9) is mounted in the latch member 106 and extends transversely of the opening 113. The latch pin 114 can move in a slot 116 (FIGS. 2 and 3) in the member 89 between a raised latched position shown in FIG. 2 and a lowered released position shown in FIG. 3. A compression spring 117 mounted in a socket 118 in the insulator member 22 urges the latch member to the raised latched position. A spool-shaped latch follower 119 is slidably mounted inside the female ground contact member 89. A compression spring 121 urges the latch follower 119 to the FIG. 3 position at which a head 122 of the follower 119 is engaged by the pin 114 to hold the latch 106 in the lowered released position of FIG. 3. When the latch 106 is in the lowered released position, a top face 123 of the head 109 of the latch member 106 is flush with an upper edge of an annular shoulder 124 which defines the upper portion of the socket 112, as shown in FIG. 3. The compression spring 121 bears on a pin 126 which is mounted in the female ground contact member 89. A pin 127 mounted in the female ground contact member 89 extends into the space between the head 122 of the latch follower 119 and a base 128 thereof to limit the movement of the follower 119.

As shown in FIG. 2, the male ground contact member 78 is mounted inside the anchor sleeve 76. The member 78 has a untiary body including a tapered compression section 134 and a threaded section 136 of generally conventional configuration. A compression nut 139 threaded on the section 136 can hold an end portion of the ground cable 18 (FIG. 1) against the tapered section 134 in a conventional manner to form an electrical connection therebetween. The compression nuts (not shown) on the threaded sections 39 (FIG. 4), 59, and 96 (FIG. 2) can be of construction similar to the nut 138. To the left of the threaded section 136 is a shoulder section 141 provided with a transverse threaded bore 142 which receives the screw 81. To the left of the shoulder section 141 is a rod portion which includes a first cylindrical section 144, a frusto-conic section 146, a second cylindrical section 147, and a conic head 148. A transverse lock slot 149 (FIG. 3) is formed in the cylindrical section 147 adjacent the head 148.

As shown in FIG. 1, the head 148 of the male ground contact member 78 extends outwardly of the insulator member 32. As the right hand end of the insulator member 22 (FIGS. 3 and 10) enters into a skirt 151 at the left hand end of the insulator member 32, the head 148 (FIG. 3) enters inside the teeth 94 of the female ground contact member 89 as shown in FIG. 3 and makes contact therein before the male contact member **38*m* (FIG. 10) makes contact with the female contact member 58. As the assembly portions 20 and 21 are advanced from the FIG. 3 position to the FIG. 2 position, the head 148 engages the latch follower 119 and advances the latch follower 119 to the left to release the pin 114 so that the latch member 106 can rise under the influence of the spring 117, and the pin 114 is received in the slot 149 to hold the portions 20 and 21 in assembled relation with firm contacts being formed at the mating members. The conic face of the head 148 is complementary to the interior of a socket 351 (FIG. 8) in the head 122 of the latch follower 119. The head 109 (FIG. 2) of the latch member 106 extends upwardly above the shoulder 124 to the indicate that the assembly is latched. When the latch member 106 is depressed to the FIG. 3 position, the portions 20 and 21 can be separated, and the latch follower 119 moves to the right to engage the latch pin 114 and hold the latch member 106 with the top face 123 thereof flush with the upper end of the shoulder 124** to indicate that the portions are not latched.

If desired, the assembly portion 21 can be mounted on an appropriate panel (not shown). An annular mounting plate 160 (FIGS. 2 and 5) is molded in the insulator member 32. Openings 161 (FIG. 5) in the plate 160 can be used to facilitate mounting.

Removal of the screws 54 (FIG. 4), 71, 79 (FIG. 2) and 81 makes possible removal of the contact members 38 and 58 in the cable connector member 77 and the male ground contact member 78 for servicing conductors attached thereto.

The cable connector assembly structure illustrated in the drawings and described above is subject to structural modification without departing from the spirit and scope of the appended claims.

We claim:

1. A cable connector assembly which comprises a pair of connector bodies, a pair of spaced parallel cable contact members mounted in each connector body, each cable contact member of one connector body being engageable with one of the cable contact members of the other connector body, a male ground contact member mounted in one of the connector bodies parallel to the cable contact members thereof and having a recess extending laterally therein, a female ground contact member mounted in the other cable connector body parallel to the cable contact members thereof, latch means in said other connector body movable transversely of the female ground contact member, first means precluding movement of said latch means into the path of said male ground contact member when the connector bodies are not in assembled relation and not precluding movement of the latch means into said recess in the male ground contact member when the connector bodies are in assemblied relation to present an abutment face in the path of withdrawal of a portion of the male ground contact member from the female ground contact member, means for attaching electrical cables to the cable contact members and means for attaching ground conductors to the ground contact members.

2. A cable connector assembly as in claim 1 wherein the ground contact members are arranged to engage as the connector bodies are advanced toward assembled relation before cable contact members are engaged.

3. A cable connector assembly as in claim 1 wherein the latch means includes a latch member body having a central opening receiving the female ground contact member, opposed sides of the opening being engageable with the female ground contact member to limit movement of the latch member body, a pin spanning the opening, there being a transverse slot in the female ground contact and a transverse slot in the male ground contact member receiving the pin when the connector bodies are in assembled relation and a portion of the latch member body means is exposed to indicate when the latch member body is in the latched position thereof.

4. A cable connector assembly as in claim 3 wherein said first means comprises a latch follower slideably mounted inside the female ground contact member and slideable therein between an advanced position in which the latch follower is engageable by the pin to limit the penetration of the pin into the slot in the female ground contact member and a retracted position free of the pin, and means urging the latch follower to advanced position, the male ground contact member being engageable with the latch follower as the connector bodies are advanced to assembled relation to retract the latch follower and permit the pin to enter the slot in the male ground contact member.

5. A cable connector assembly as in claim 4 wherein there is means urging the latch member body to the position at which the pin is received in the slot of the male ground contact member.

6. A cable connector assembly as in claim 1 wherein the means for attaching a ground conductor to the female ground contact member includes a cable connector member removably mounted in the other connector body in connection with the female ground contact member and means on the cable connector member for attaching the ground conductor thereto.

7. A cable connector assembly as in claim 6 wherein the cable connector member includes a rod section which is received inside an end portion of the female ground contact member in electrical connecting relation therewith.

8. A cable connector assembly which comprises a pair of connector bodies, a cable contact mounted in each connector body, the cable contact of one connector body being engageable with the cable contact of the other connector body, a male ground member mounted in one of the connector bodies parallel to the cable contact thereof and having a recess extending laterally therein, a female ground contact member mounted in the other cable connector body parallel to the cable contact thereof, latch means in said other connector body movble transversely of the female ground contact member, first means precluding movement of said latch means into the path of said male ground contact member when the connector bodies are not in assembled relation and not precluding movement of the latch means into said recess in the male ground contact member when the connector bodies are in assembled relation to present an abutment face in the path of withdrawl of a portion of the male ground contact member from the female ground contact member, means for attaching electrical cables to the cable contact members and means for attaching ground conductors to the ground contact members.

9. In a cable connector assembly, a cable connector body having a lengthwise bore, an anchor sleeve mounted in the body inside the bore coaxially of the bore, a contact member slideably received in the bore and in the anchor sleeve, interacting guides on the anchor sleeve and on the contact member for limiting turning of the contact member inside the anchor sleeve and for aligning the contact member in the anchor sleeve, and releasable fastener means extending through a wall of the body and through the anchor sleeve and into the contact member substantially radially of the bore to hold the contact member in the bore in aligned position.

10. A cable connector body as in claim 9 wherein the interacting guides comprise a slot in the anchor sleeve and a radial pin in the contact member.

11. The combination of a male contact member for a cable connector assembly which comprises a body, means for attaching a conductor to the body, and a contact head of substantially cylindrical shape and provided at a free end with a diametral slot to form a pair of spring teeth, with a dielectric plug having a portion overlying the free end of the head and a tongue portion extending between the teeth, and a retaining pin mounted in the tongue and received in radial openings in the teeth to retain the plug in position on the head, the teeth being advanceable along the pin when the teeth are compressed inwardly.

12. In a cable connector assembly as in claim 8, the cable connector body having a lengthwise bore, an anchor sleeve mounted in the body inside the bore coaxially of the bore, a contact member slideably received in the bore and in the anchor sleeve, interacting guides on the anchor sleeve and on the contact member for limiting turning of the contact member inside the anchor sleeve and for aligning the contact member in the anchor sleeve, and releasable fastener means extending through a wall of the body and through the anchor sleeve and into the contact member substantially radially of the bore to hold the contact member in the bore inn aligned position.

13. A cable connector body as in claim 12 wherein the interacting guides comprise a slot in the anchor sleeve and a radial pin inn the contact member.

14. In a cable connector assembly as in claim 12, which comprises a body, means for attaching a conductor to the body, and a contact head of substantially cylindrical shape and provided at a free end with a diametral slot to form a pair of spring teeth, a dielectric plug having a portion overlying the free end of the head and a tongue portion extending between the teeth, and a retaining pin mounted in the tonque and received in radial openings in the teeth to retain the plug in position on the head, the teeth being advanceable along the pin when the teeth are compressed inwardly.

* * * * *